US008031139B2

(12) United States Patent
Nam et al.

(10) Patent No.: US 8,031,139 B2
(45) Date of Patent: Oct. 4, 2011

(54) PLASMA DISPLAY DEVICE, AND DRIVING DEVICE AND METHOD THEREOF

(75) Inventors: Sang-Min Nam, Suwon-si (KR); Jung-Pil Park, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 925 days.

(21) Appl. No.: 11/963,561

(22) Filed: Dec. 21, 2007

(65) Prior Publication Data

US 2008/0180359 A1 Jul. 31, 2008

(30) Foreign Application Priority Data

Jan. 30, 2007 (KR) ..... 10-2007-0009357

(51) Int. Cl.
*G09G 3/28* (2006.01)
*G09G 5/00* (2006.01)

(52) U.S. Cl. ..... 345/67; 345/208

(58) Field of Classification Search ..... 345/60–72, 345/208

See application file for complete search history.

(56) References Cited

U.S. PATENT DOCUMENTS 5,745,086 A 4/1998 Weber
2006/0103602 A1* 5/2006 Kim ..... 345/67

FOREIGN PATENT DOCUMENTS

KR 10-2005-0083006 A 8/2005
KR 10-2005-0110946 11/2005
KR 10-2006-0084157 A 7/2006
KR 10-2006-0119415 A 11/2006

OTHER PUBLICATIONS

Korean Patent Abstracts, Publication No. 1020050110946 A; Date of Publication: Nov. 24, 2005; in the name of Jin Sung Kim et al.

* cited by examiner

*Primary Examiner* — Kevin Nguyen
*Assistant Examiner* — Randal Willis
(74) *Attorney, Agent, or Firm* — Christie, Parker & Hale, LLP

(57) ABSTRACT

In a plasma display device, a source of a first transistor S1 is coupled to an X electrode, and a drain thereof is coupled to a cathode of a diode D1. An anode of the diode D1 is coupled to a first power source for supplying a first voltage V1. A drain of the first transistor S1 is coupled to a drain of a second transistor S2 through a capacitor, and a source of the second transistor S2 is coupled to a ground source for supplying a second voltage of 0 V. A third transistor S3 has a source coupled to the drain of the second transistor S2 and a drain coupled to a third power source for supplying a third voltage V2, and a fourth transistor S4 has a drain coupled to the X electrode and a source coupled to the drain of the second transistor S2.

14 Claims, 11 Drawing Sheets

PLASMA DISPLAY DEVICE, AND DRIVING DEVICE AND METHOD THEREOF

CROSS-REFERENCE TO RELATED APPLICATION

This application claims priority to and the benefit of Korean Patent Application No. 10-2007-0009357 filed in the Korean Intellectual Property Office on Jan. 30, 2007, the entire content of which is incorporated herein by reference.

BACKGROUND OF THE INVENTION

1. Field of the Invention

The present invention relates to a plasma display device, driving device and a method of driving the same.

2. Description of the Related Art

A plasma display device is a display device using a plasma display panel that displays characters or images using plasma generated by a gas discharge. In the plasma display panel, a plurality of discharge cells are arranged in a matrix.

In the plasma display device, one frame is divided into a plurality of subfields each having a weight value, and each of the subfields includes a reset period, an address period and a sustain period. In the reset period the discharge cells are initialized in order to stably perform an address discharge. In the address period, cells to be turned on and cells not to be turned on are selected from the plurality of discharge cells. In the sustain period, a sustain discharge is performed on the cells to be turned on in order to actually display an image.

In order to perform these operations, sustain pulses are alternately supplied to scan electrodes and sustain electrodes in the sustain period, and reset waveforms and scanning waveforms are applied to the scan electrodes during the reset period and the address period. Therefore, a scanning driving board for driving the scan electrodes and a sustain driving board for driving the sustain electrodes are separately needed. The structure in which the driving boards are separately provided has a problem in that the driving boards are mounted on a chassis base, and the two driving boards cause an increase in manufacturing cost.

The above information disclosed in this Background section is only for enhancement of understanding of the background of the invention and therefore it may contain information that does not form the prior art that is already known in this country to a person of ordinary skill in the art.

SUMMARY OF THE INVENTION

In exemplary embodiments according to the present invention, a plasma display device capable of reducing the size of a sustain driving board for driving a sustain electrode and of applying several types of bias voltages to improve discharge characteristics and a method of driving the plasma display device, are provided.

According to an exemplary embodiment of the present invention, a plasma display device having a plurality of cells for displaying an image, is provided. The plasma display device includes: a plurality of first electrodes; a first transistor having a first terminal electrically coupled to the plurality of first electrodes and a second terminal electrically coupled to a first power source for supplying a first voltage; a second transistor having a first terminal electrically coupled to the plurality of first electrodes; a first capacitor having a first terminal electrically coupled to the second terminal of the first transistor and a second terminal electrically coupled to a second terminal of the second transistor; a third transistor having a first terminal electrically coupled to the second terminal of the first capacitor and a second terminal electrically coupled to a second power source for supplying a second voltage; and a fourth transistor having a first terminal electrically coupled to the second terminal of the first capacitor and a second terminal electrically coupled to a third source for supplying a third voltage.

According to another embodiment of the present invention, there is provided a method of driving a plasma display device including a plurality of first electrodes and a plurality of second electrodes that perform a display operation. The method of driving a plasma display device includes: turning on a plurality of transistors that are electrically coupled between a first power source for supplying a first voltage and the plurality of first electrodes during an address period to apply the first voltage to the plurality of first electrodes; turning on a plurality of second transistors that are electrically coupled to a second power source for supplying a second voltage during a sustain period to apply the second voltage to the plurality of first electrodes; turning on the plurality of first transistors and a plurality of third transistors that are electrically coupled to a third power source for supplying a third voltage during a pre-reset period to apply a fifth voltage corresponding to the sum of the third voltage and the fourth voltage to the plurality of first electrode through a first capacitor having a fourth voltage charged thereto; turning on the plurality of second transistors that are electrically coupled to the second power source for supplying the second voltage during a rising period of a reset period to apply the second voltage to the plurality of first electrodes; and applying the third voltage to the plurality of first electrodes through at least one of the plurality of second transistors and the plurality of third transistors that are electrically coupled to the third power source for supplying the third voltage during a falling period of the reset period.

According to another exemplary embodiment of the present invention, a method of driving a plasma display device including a plurality of first electrodes and a plurality of second electrodes for performing a display operation during a plurality of subfields, is provided. At least one of the subfields includes an address period, a sustain period, a pre-reset period and a reset period. The method includes: turning on at least one first transistor that is electrically coupled between a first power source for supplying a first voltage and the plurality of first electrodes during the address period to apply the first voltage to the plurality of first electrodes; turning on at least one second transistor that is electrically coupled to a second power source for supplying a second voltage during the sustain period to apply the second voltage to the plurality of first electrodes; turning on the at least one first transistor and at least one third transistor that is electrically coupled to a third power source for supplying a third voltage during the pre-reset period to apply a fifth voltage corresponding to a sum of the third voltage and the fourth voltage to the plurality of first electrodes through a first capacitor having a fourth voltage charged thereto; turning on the at least one second transistor that is electrically coupled to the second power source for supplying the second voltage during a rising period of the reset period to apply the second voltage to the plurality of first electrodes; and applying the third voltage to the plurality of first electrodes through at least one of the at least one second transistor or the at least one third transistor that is electrically coupled to the third power source for supplying the third voltage during a falling period of the reset period.

According to still another exemplary embodiment of the present invention, there is provided a device for driving a plasma display device including first electrodes and second electrodes. The device for driving a plasma display device includes: a first path which is formed between a first power source for supplying a first voltage and the first electrode and through which the first voltage is supplied to the first electrode; a second path which is formed between the first power source and a second power source for supplying a second voltage and through which a first capacitor having a first terminal coupled to the first power source and a second terminal coupled to the second power source is charged to a third voltage; a third path that is formed between a third power source for supplying a fourth voltage and the first electrode and allows a fifth voltage to be supplied to the first electrode through the first capacitor charged to the third voltage; a fourth path which is formed between the second power source and the first electrode and through which the second voltage is supplied to the first electrode; and a fifth path which is formed between the third power source and the first electrode and through which the fourth voltage is supplied to the first electrode.

According to still another exemplary embodiment of the present invention, a device for driving a plasma display device including a first electrode and a second electrode, is provided. The device includes: a first path between a first power source for supplying a first voltage and the first electrode, wherein the first voltage is supplied to the first electrode through the first path; a second path between the first power source and a second power source for supplying a second voltage, wherein a first capacitor having a first terminal coupled to the first power source and a second terminal coupled to the second power source is charged to a third voltage through the second path; a third path between a third power source for supplying a fourth voltage and the first electrode and for allowing a fifth voltage to be supplied to the first electrode through the first capacitor charged to the third voltage; a fourth path between the second power source and the first electrode, wherein the second voltage is supplied to the first electrode through the fourth path; and a fifth path between the third power source and the first electrode, wherein the fourth voltage is supplied to the first electrode through the fifth path.

DETAILED DESCRIPTION OF THE EMBODIMENTS

Figure 1:
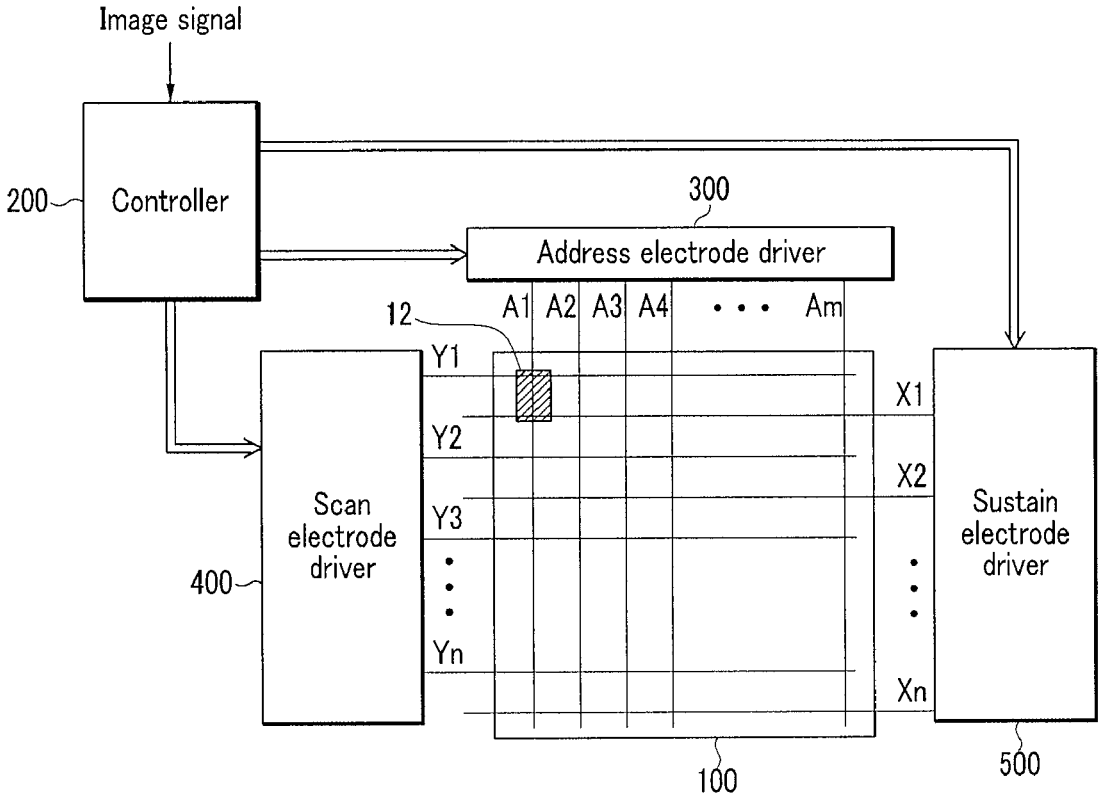
FIG. 1 is a diagram illustrating a plasma display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. In the drawings, in order to clearly describe the present invention, some of the parts that are not essential to the complete understanding of the invention are omitted, and the same components have the same reference numerals throughout the specification.

In the specification, the "connection" or "coupling" between two parts includes the "electrical connection" between the two parts with an element interposed therebetween as well as the "direct connection" therebetween. In addition, it will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. two specific points varies with time and a voltage variation caused by a parasitic component which can be neglected in the design in this technical field. Since a threshold voltage of a semiconductor device (for example, a transistor and a diode) is considerably lower than a discharge voltage, the threshold voltage is assumed to be approximately 0 V herein for the ease of description.

Hereinafter, a plasma display device, a device for driving the same, and a method of driving the same according to an exemplary embodiment of the present invention will be described in detail with reference to the accompanying drawings.

FIG. 1 is a diagram illustrating a plasma display device according to an exemplary embodiment of the present invention.

As shown in FIG. 1, the plasma display device according to an exemplary embodiment of the present invention includes a plasma display panel (PDP) 100, a controller 200, an address electrode driver 300, a scan electrode driver 400 and a sustain electrode driver 500.

The plasma display panel 100 includes a plurality of address electrodes (hereinafter, referred to as "A electrodes") A1 to Am extending in a column direction and a plurality of pairs of sustain electrodes (hereinafter, referred to as "X electrodes") X1 to Xn and scan electrodes (hereinafter, referred to as "Y electrodes") Y1 to Yn extending in a row direction. In general, the X electrodes X1 to Xn are formed so as to correspond to the Y electrodes Y1 to Yn, and the X electrodes and the Y electrodes perform a display operation for displaying an image in a sustain period. The Y electrodes Y1 to Yn and the X electrode X1 to Xn are disposed so as to cross the A electrodes A1 to Am. In this case, discharge spaces disposed at crossings of the A electrodes A1 to Am and the X and Y electrodes X1 to Xn and Y1 to Yn form cells 12. The structure of the plasma display panel 100 is just an illustrative example, and panels having different structures to which the following driving waveforms can be applied may be applied to exemplary embodiments of the present invention.

The controller 200 receives a video signal from an external source, and outputs an A electrode driving control signal, an X electrode driving control signal, and a Y electrode driving control signal. The controller 200 divides one frame into a plurality of subfields and drives the divided subfields, and each of the subfields includes an address period and a sustain period.

The address electrode driver 300 receives the A electrode driving control signal from the controller 200, and applies a driving voltage to the A electrodes A1 to Am.

The scan electrode driver 400 receives the Y electrode driving control signal from the controller 200 and applies the driving voltage to the Y electrodes Y1 to Yn.

As will be described below, the sustain electrode driver 500 does not apply a sustain pulse to the X electrodes, but applies only a bias voltage thereto, according to an exemplary embodiment of the present invention.

Figure 2:
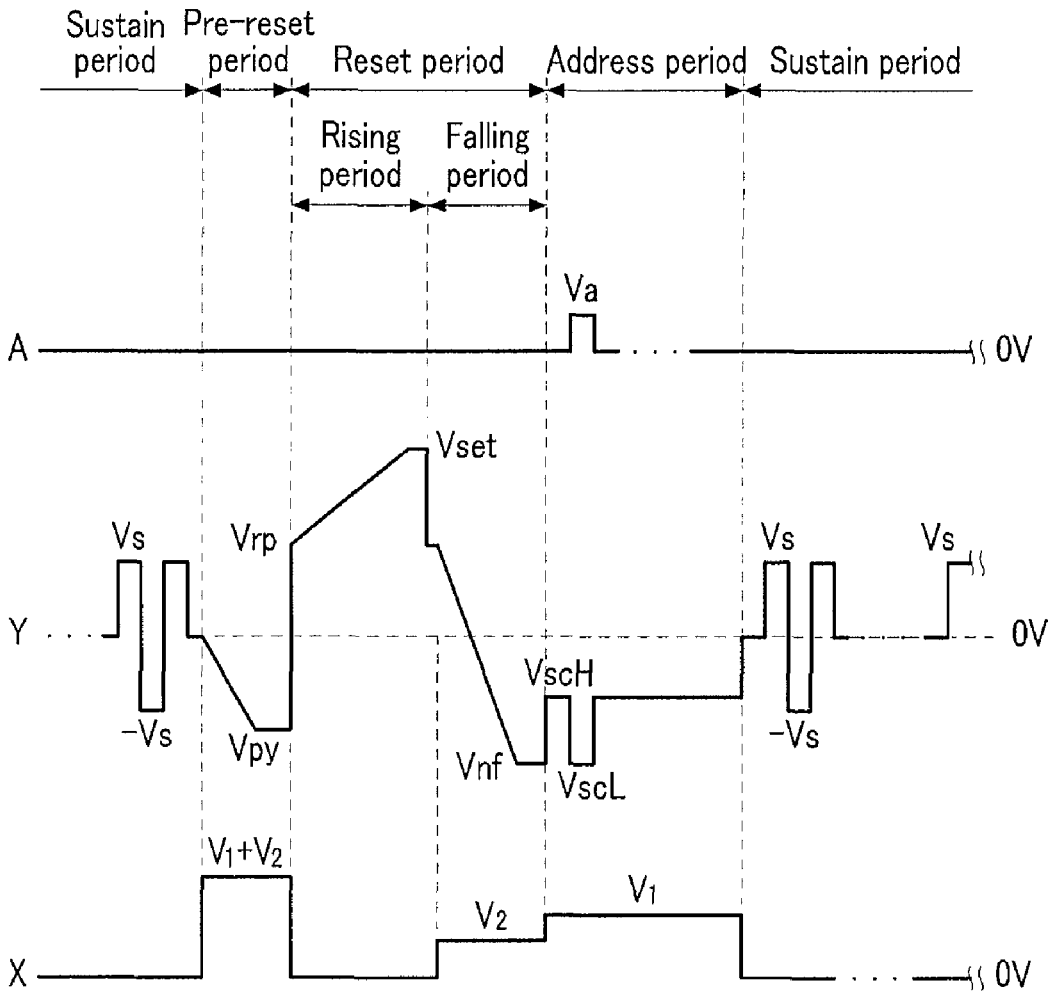
FIG. 2 is a diagram schematically illustrating driving waveforms for the plasma display device according to an exemplary embodiment of the present invention.

FIG. 2 is a diagram schematically illustrating driving waveforms of a plasma display device according to an exemplary embodiment of the present invention.

As shown in FIG. 2, in a rising period of a reset period, the voltage of the Y electrode gradually increases from a voltage Vrp to a voltage Vset with the voltage of the A electrode and the X electrode kept at a reference voltage (in FIG. 2, 0 V). FIG. 2 shows the voltage of Y electrode increasing in a ramp pattern. While the voltage of the Y electrode increases, a weak discharge occurs between the Y electrode and the X electrode and between the Y electrode and the A electrode, and a negative wall charge and a positive wall charge are formed at the Y electrode and the X and A electrodes, respectively. As shown in FIG. 2, when the voltage of the electrode gradually varies, the weak discharge occurs and the wall charge is formed such that the sum of a voltage applied from the outside and the wall voltage of the cell is maintained at a discharge firing voltage. This principle is disclosed in U.S. Pat. No. 5,745,086 applied by Weber. In the reset period, all cells should be initialized. Therefore, the voltage Vset is high enough to generate discharge in all the cells.

In a falling period of the reset period, the voltage of the Y electrode gradually decreases from a voltage Vrp to a voltage Vnf with the voltage of the X electrode kept at a voltage V2. Then, while the voltage of the Y electrode decreases, the weak discharge occurs between the Y electrode and the X electrode and between the Y electrode and the A electrode, and the negative wall charge formed at the Y electrode and the positive wall charge formed at the X electrode and the A electrode are removed, which causes the discharge cell to be initialized. In general, the voltage Vnf-V2 is set to be about the discharge firing voltage between the Y electrode and the X electrode. The wall voltage between the Y electrode and the X electrode then becomes almost 0 V, which makes it possible to prevent the cell that is not turned on in the address period from being discharged in the sustain period.

However, when the wall voltages between the X electrode and the Y electrode and between the A electrode and the Y electrode are approximately 0 V, the discharge between the A electrode and the Y electrode subfield occurs earlier than the discharge between the X electrode and the Y electrode in a reset period of the next subfield, which results in a strong discharge. Specifically, after the reset period elapses in a certain subfield, the wall voltage between the X electrode and the Y electrode and the wall voltage due to the wall charge between the A electrode and the Y electrode are approximately 0 V. In addition, in the cell that does not emit light in the address period, the state of the wall charge when the reset period has elapsed is maintained. At that time, the discharge firing voltage between the A electrode and the Y electrode is set to be lower than the discharge firing voltage between the X electrode and the Y electrode. Therefore, when the voltage of the Y electrode increases in the reset period of the subsequent subfield, the voltage between the A electrode and the Y electrode is higher than the discharge firing voltage. Therefore, the high voltage may cause a strong discharge, not a weak discharge, to occur between the A electrode and the Y electrode. In order to prevent the strong discharge in the reset period, according to an exemplary embodiment of the present invention, a period for which the wall voltage is formed between the Y electrode and the X electrode (hereinafter, referred to as a "pre-reset period") is disposed before the rising period of the reset period.

In the pre-reset period, the voltage of the Y electrode gradually decreases from a reference voltage of 0 V to a voltage Vpy, with a voltage V1+V2 being applied to the X electrode. Then, in the pre-reset period, the positive wall charge and the negative wall charge may be formed at the Y electrode and the X electrode, respectively. The wall charges cause the discharge between the Y electrode and the X electrode to occur earlier than the discharge between the Y electrode and the A electrode in the rising period of the reset period when the voltage of the Y electrode increases, which makes it possible to prevent the strong discharge in the reset period.

Further, a voltage V1 that is higher than the voltage in the falling period of the reset period is applied to the X electrode in order to facilitate the address discharge between the X electrode and the Y electrode in the address period. That is, in the address period, in order to improve discharge characteristics, a scanning pulse having a voltage VscL and an address pulse having a voltage Va are applied to the Y electrode and the A electrode, respectively, with the voltage of the X electrode kept at a voltage V1 that is higher than a voltage V2 in the falling period of the reset period. A voltage VscH that is higher than the voltage Vscl is applied to the Y electrodes that are not selected, and the reference voltage of 0 V is applied to the A electrodes of the cells that will not be turned on. Then, the address discharge occurs in the discharge cell formed by the A electrode having the voltage Va applied thereto and the Y electrode having the voltage VscL applied thereto, and thus the positive wall charge and the negative wall charge are formed at the Y electrode and the A and X electrodes, respectively.

Subsequently, in the sustain period, a high-level voltage Vs and a low-level voltage—Vs are alternately applied to the Y electrode. Then, a discharge occurs in the Y electrode by the voltage Vs and the wall voltage that is formed between the Y electrode and the X electrode due to the address discharge in the address period. Thereafter, a process of applying the sustain pulse to the Y electrode is repeated a number (e.g., a predetermined number) of times corresponding to a weight value represented by a corresponding subfield.

As described above, in the exemplary embodiment of the invention, the voltage V2 is applied to the X electrode in the falling period of the reset period, the voltage V1 is applied to the X electrode in the address period, the voltage V1+V2 is applied to the X electrode in the pre-reset period. In the other periods, it is possible to perform a reset operation, an address operation, and a sustain operation by using only the driving waveform applied to the Y electrode, with the reference voltage of 0 V applied to the X electrode.

In this case, since the X electrode supplies only a bias voltage, the occupied area of the X electrode in a driving board decreases, as compared with the existing driving board including the sustain discharge pulse, which makes it possible to reduce the total cost of a circuit for driving a plasma display panel.

Next, a driving circuit for a plasma display device according to an exemplary embodiment of the present invention will be described with reference to FIG. 3.

Figure 3:
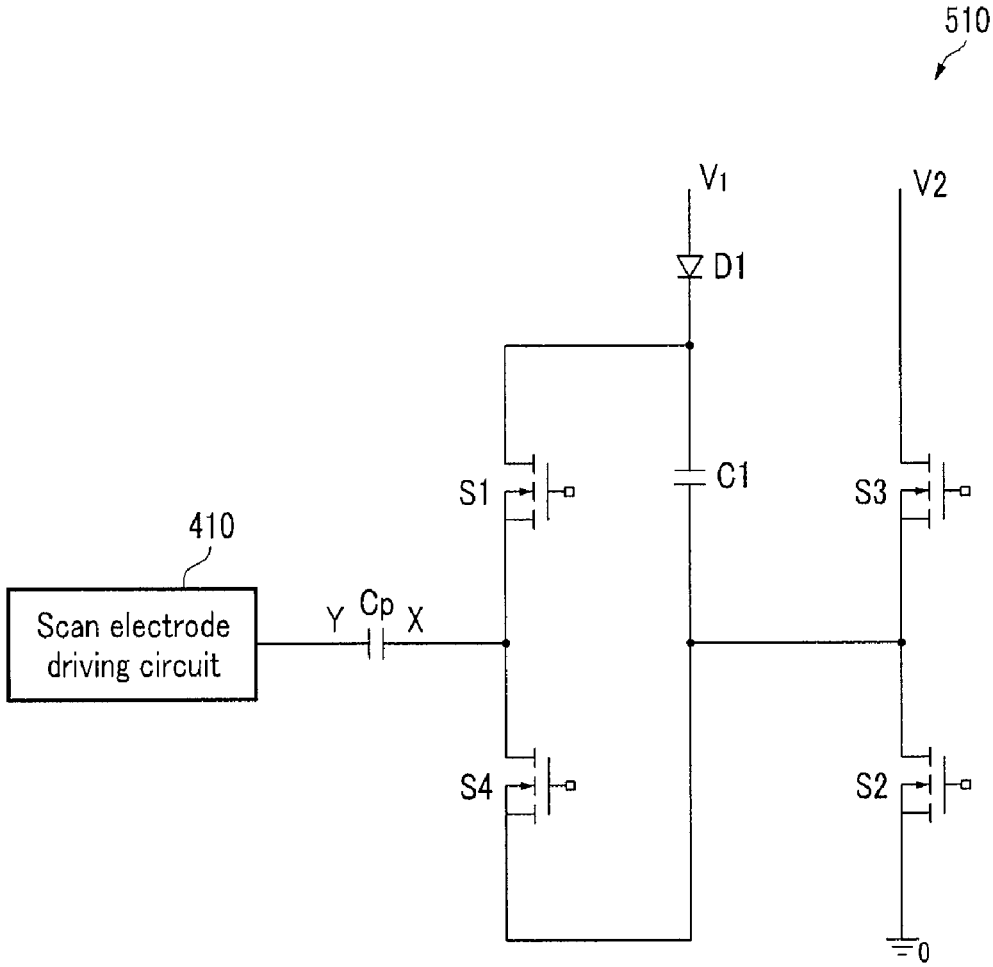
FIG. 3 is a diagram schematically illustrating a driving circuit of a sustain electrode driver according to an exemplary embodiment of the present invention.

FIG. 3 is a diagram schematically illustrating a driving circuit 510 of a sustain electrode driver 500 according to an exemplary embodiment of the present invention. For the purpose of better understanding and ease of description, FIG. 3 shows only the sustain electrode driving circuit 510 coupled to a plurality of X electrodes X1 to Xn. However, a driving circuit 410 (e.g., in a scanning driving board) is also coupled to a plurality of Y electrodes Y1 to Yn. The driving circuit 510 in one embodiment is formed in the sustain electrode driver 500 shown in FIG. 1.

In the driving circuit 510 shown in FIG. 3, a capacitive component formed by one X electrode and one Y electrode is shown as a panel capacitor Cp.

As shown in FIG. 3, the driving circuit 510 includes transistors S1, S2, S3, and S4, a capacitor C1, and a diode D1. In FIG. 3, the transistor S1, S2, S3, and S4 are n-channel field effect transistors, particularly NMOS (n-channel metal oxide semiconductor) transistors. In the transistors S1, S2, S3, and S4, a body diode is formed in the direction from a source to a drain. Instead of the NMOS transistors, other transistors having similar functions may be used as the transistors S1, S2, S3, and S4. In FIG. 3, each of the transistors S1, S2, S3, and S4 is illustrated as being composed of one transistor. However, each of the transistors S1, S2, S3, and S4 may be composed of a plurality of transistors coupled in parallel to each other.

As shown in FIG. 3, the transistor S1 has a source coupled to the X electrode and a drain coupled to a cathode of the diode D1. An anode of the diode D1 is coupled to a first power source for supplying a first voltage V1. A drain of the transistor S1 is coupled to a drain of the transistor S2 through the capacitor C1, and a source of the transistor S2 is coupled to a ground source for supplying a second voltage. A source of the transistor S3 is coupled to the drain of the transistor S2, and a drain of the transistor S3 is coupled to a third power source for supplying a third voltage V2. The transistor S4 has a drain coupled to the X electrode and a source coupled to the drain of the transistor S2.

Next, the operation of the sustain electrode driving circuit 510 shown in FIG. 3 will be described in detail with reference to FIG. 4 and FIGS. 5A to 5E.

Figure 4:
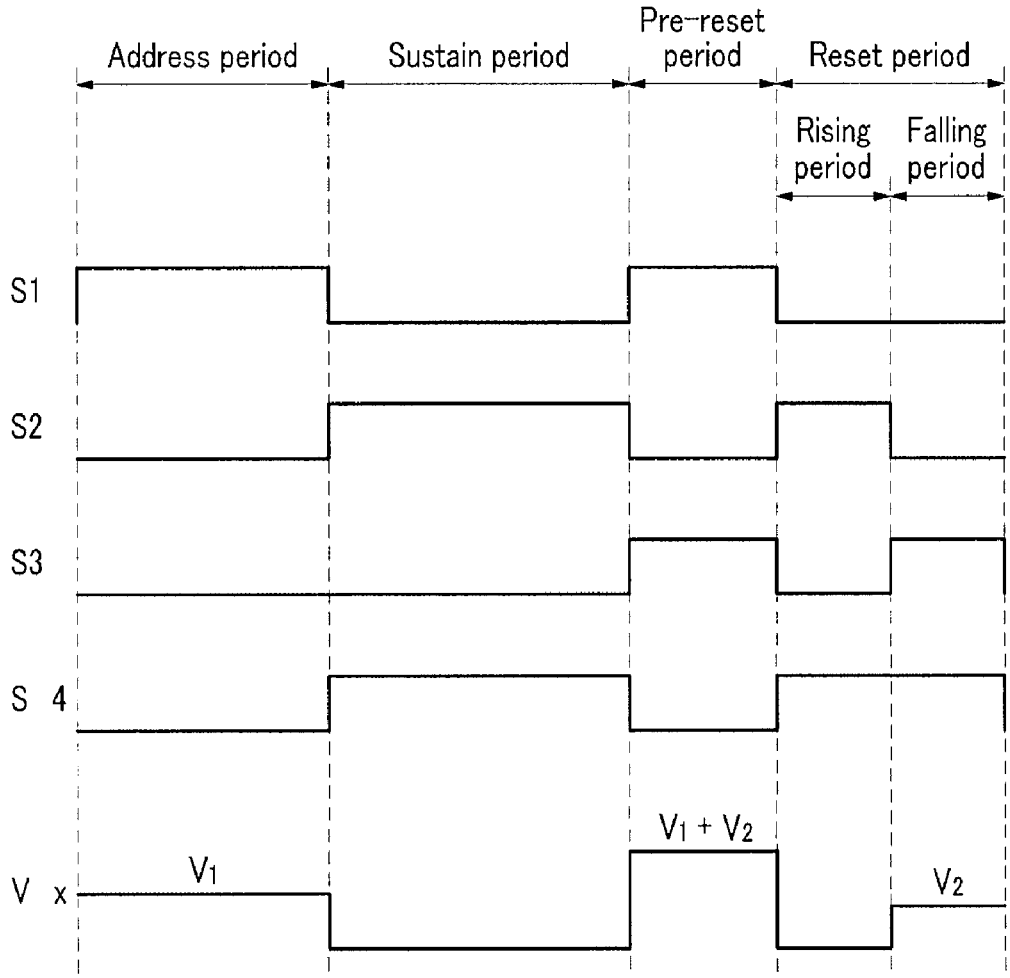
FIG. 4 is a diagram illustrating the signal timing of a driving circuit according to an exemplary embodiment of the present invention.

FIG. 4 is a diagram illustrating signal timing of the sustain electrode driving circuit 510 according to an exemplary embodiment of the present invention, and FIGS. 5A to 5E are diagrams illustrating the operation of the sustain discharge circuit 510 shown in FIG. 3 according to the signal timing shown in FIG. 4.

First, it is assumed that the transistors S3 and S4 are turned on immediately before the address period shown in FIG. 4 (in the falling period of the reset period), causing the voltage Vx of the X electrode to be maintained at the voltage V2.

Figure 5A:
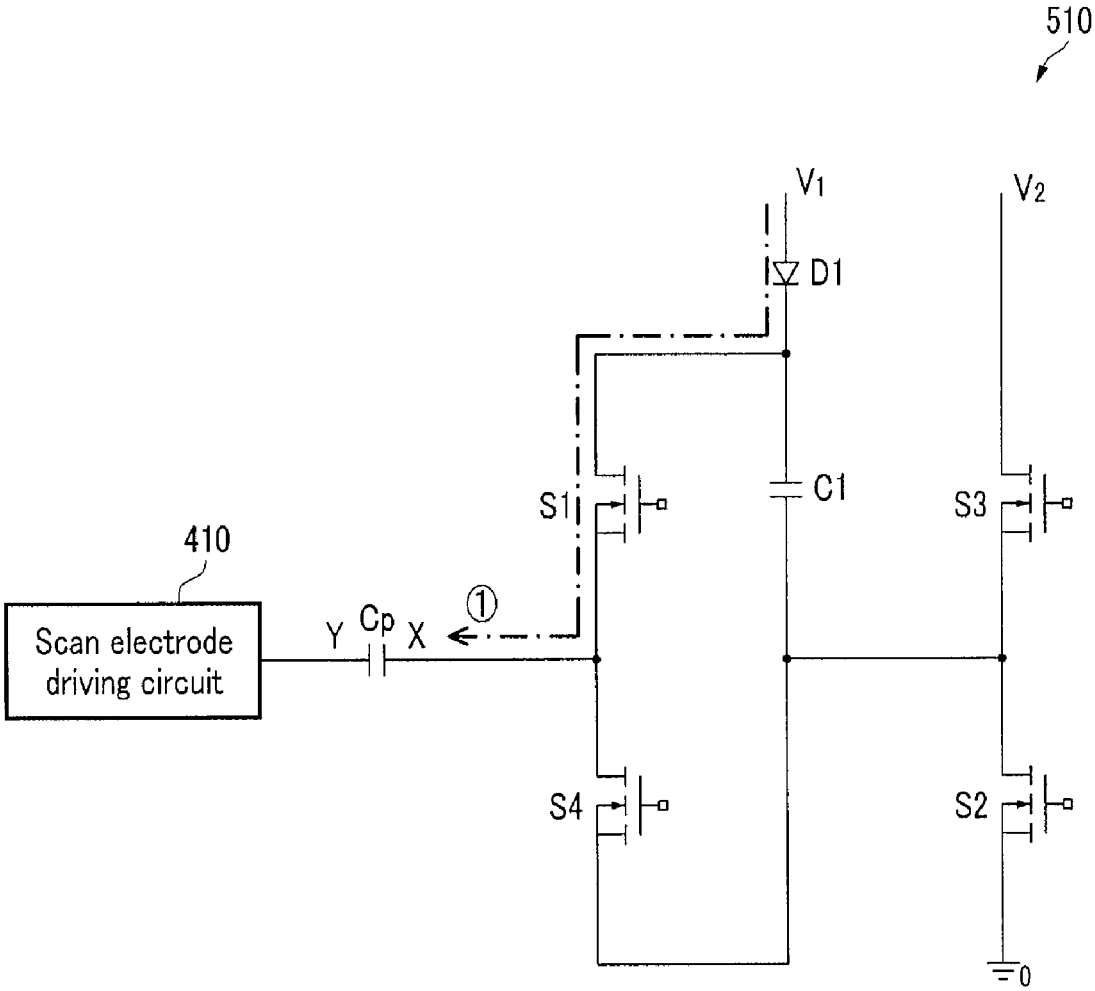
FIGS. 5A to 5E are diagrams illustrating the operation of the driving circuit shown in FIG. 3 according to the signal timing shown in FIG. 4.

As shown in FIG. 4 and FIG. 5A, in the address period, the transistors S3 and S4 are turned off, and the transistor S1 is turned on. Then, as shown in FIG. 5A, a path ① composed of the first power source for supplying the voltage V1, the diode D1, the transistor S1, and panel capacitor Cp is formed, and the voltage V1 is applied to the X electrode through the first path, which causes the voltage Vx of the X electrode to be maintained at the voltage V1.

Figure 5B:
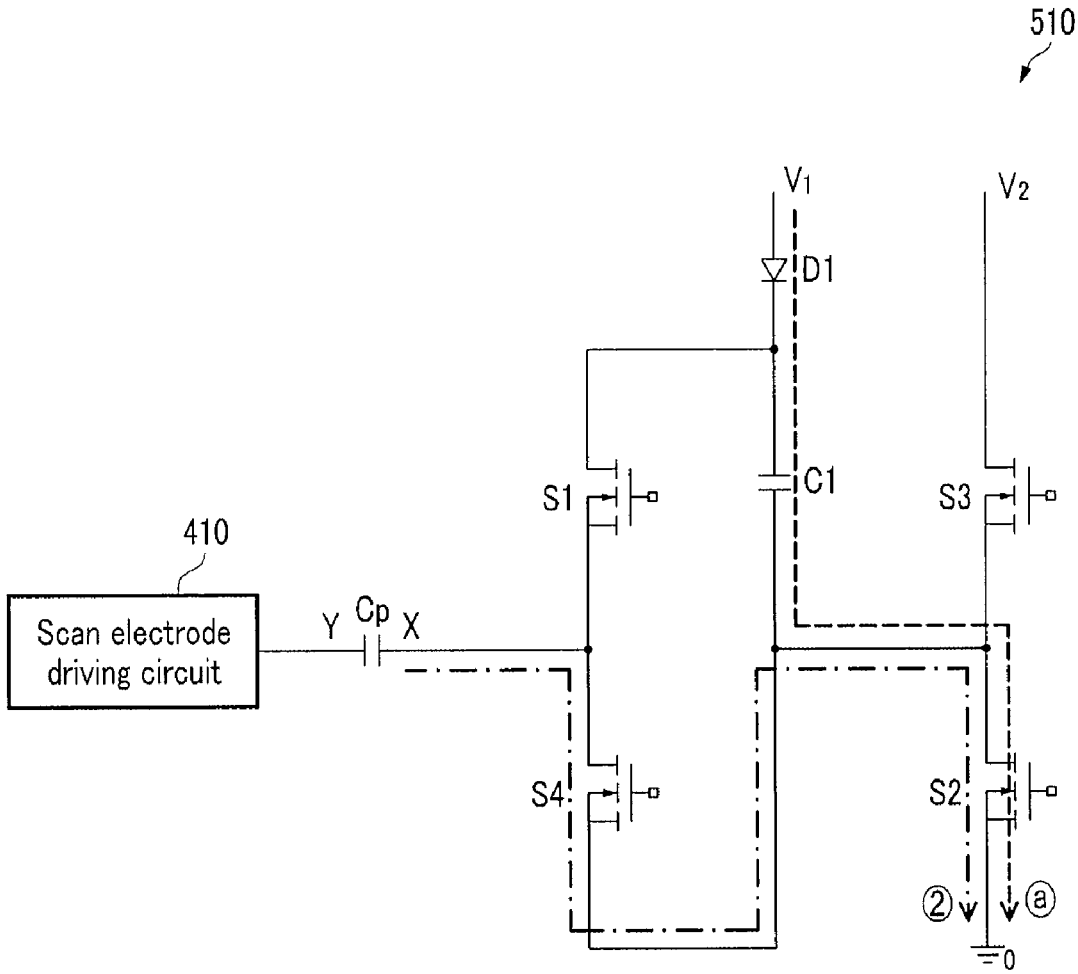

In the sustain period, the transistor S1 is turned off, and the transistors S2 and S4 are turned on. Then, as shown in FIG. 5B, a path ② composed of the capacitor Cp, the transistor S4, the transistor S2, and the ground source is formed, which causes the voltage Vx of the X electrode to be maintained at the voltage of 0 V. Further, a path ⓐ composed of the first power source for supplying the voltage V1, the diode D1, the capacitor C1, the transistor S2, and the ground source is formed, which causes the capacitor C1 to be charged at the voltage V1. In this case, in the transistor S3, the source is maintained at the voltage of 0 V, and the drain is maintained at the voltage V2. Therefore, a transistor that can resist the voltage V2 may be used as the transistor S3. In the transistor S1, the source is maintained at the voltage of 0 V, and the drain is maintained at the voltage V1. Therefore, a transistor that can resist the voltage V1 may be used as the transistor S1.

Figure 5C:
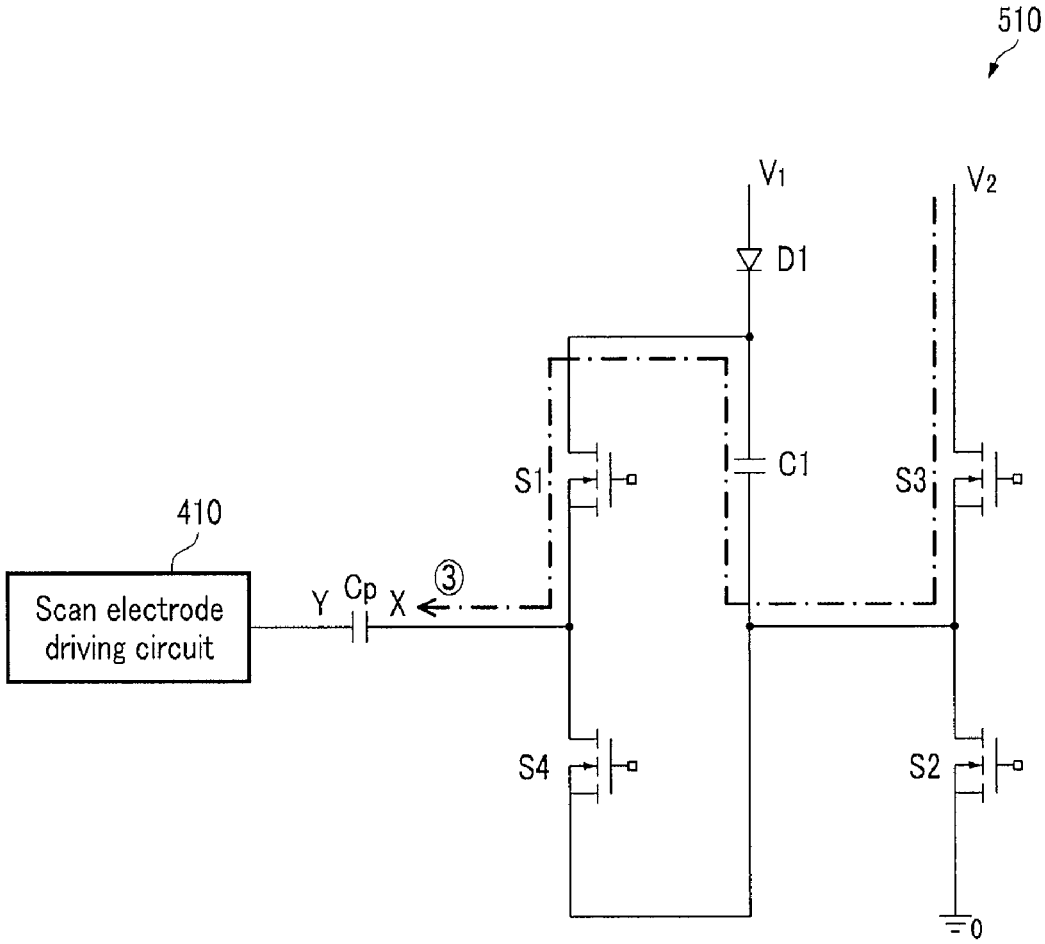

Then, in the pre-reset period, the transistors S2 and S4 are turned off, and the transistors S1 and S3 are turned on. Then, as shown in FIG. 5C, a path ③ composed of the power source for supplying the voltage V2, the transistor S3, the capacitor C1, the transistor S1, and the panel capacitor Cp is formed. In this case, since the capacitor C1 is charged at the voltage V1 during the sustain period, a voltage V1+V2, which is the sum of the voltage V1 previously charged by the capacitor C1 and the power supply voltage V2, is applied to the X electrode. In the transistor S2, the source is maintained at the voltage of 0 V, and the drain is maintained at the voltage V2. Therefore, a transistor that can resist the voltage V2 may be used as the transistor S2.

Figure 5D:
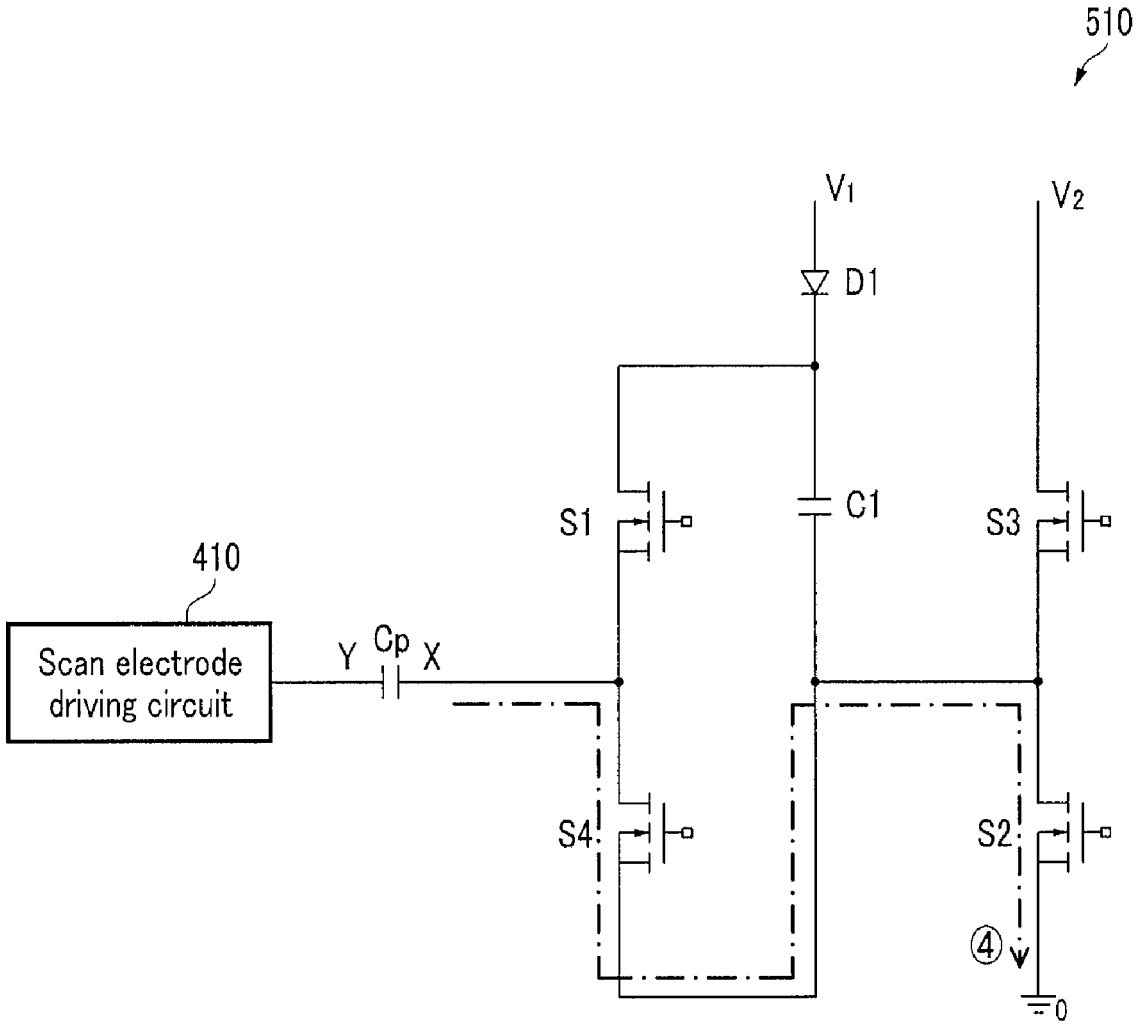

In the rising period of the reset period, the transistors S1 and S3 are turned off, and the transistors S2 and S4 are turned on. Then, as shown in FIG. 5D, a path ④ composed of the capacitor Cp, the transistor S4, the transistor S2, and the ground source is formed. A voltage of 0 V is applied to the X electrode through the path, which causes the voltage Vx of the X electrode to be maintained at a voltage of 0 V.

Figure 5E:
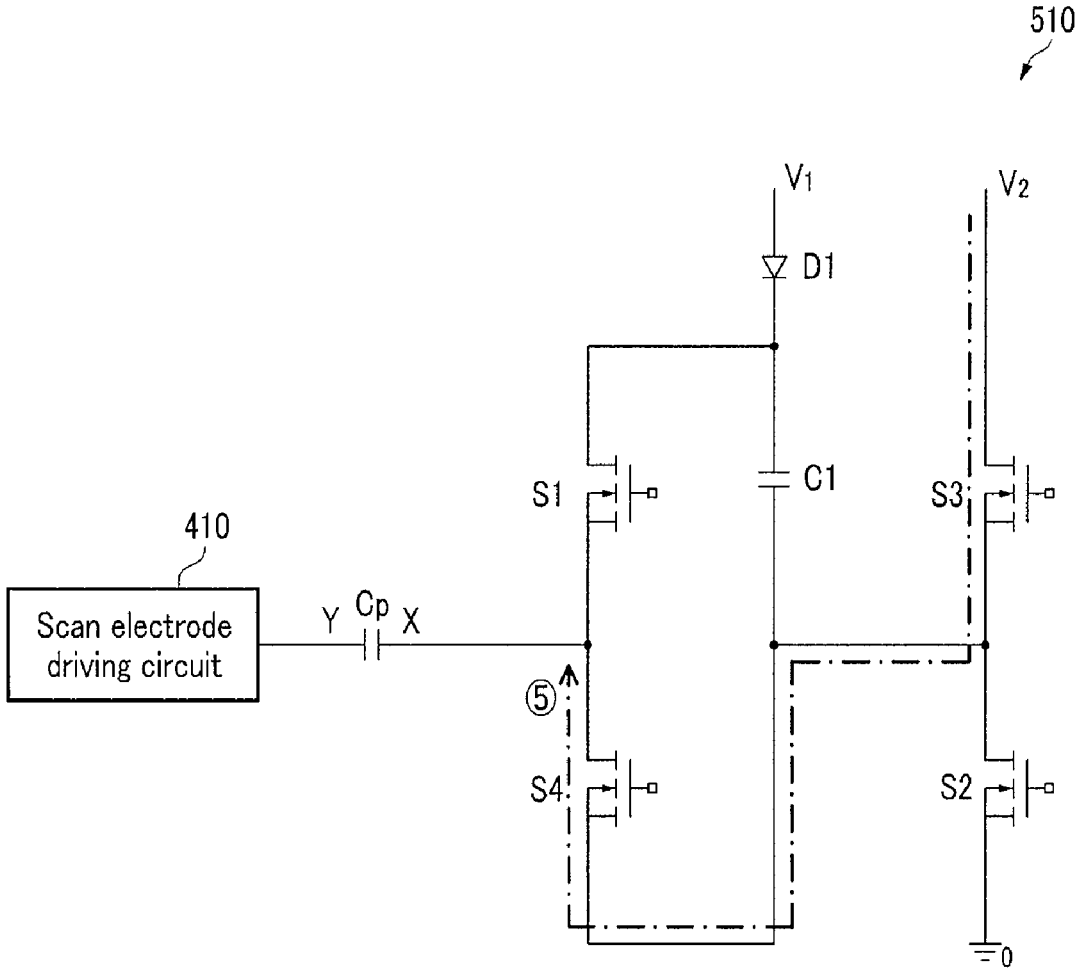

In the falling period of the reset period, with the transistor S4 being turned on, the transistor S2 is turned off, and the transistor S3 is turned on. Then, as shown in FIG. 5E, a path ⑤ composed of the power source for supplying the voltage V2, the transistor S3, the body diode of the transistor S4, and the capacitor Cp is formed, and the voltage V2 is applied to the X electrode through the path, which causes the voltage Vx of the X electrode to be maintain at the voltage V2.

Therefore, in the driving circuit diagram of the plasma display device according to an exemplary embodiment of the present invention, two power sources and one capacitor, not three power sources, are used to generate three biases. That is, the above-described embodiment has a feature (e.g., an advantage) in that a small (or less) number of power sources can be used. In addition, even when the voltage V1+V2 is supplied, transistors can be designed such that the transistor S1 resists the voltage V1 and the transistors S2 and S3 resist the voltage V2. That is, this embodiment has a feature (e.g., an advantage) in that, even when the voltage V1+V2 is supplied, each transistor can resist the voltage V1 or V2, but not necessarily the sum of the voltages V1 and V2. This way, it is possible to use transistors having lower resisting voltage.

Figure 6:
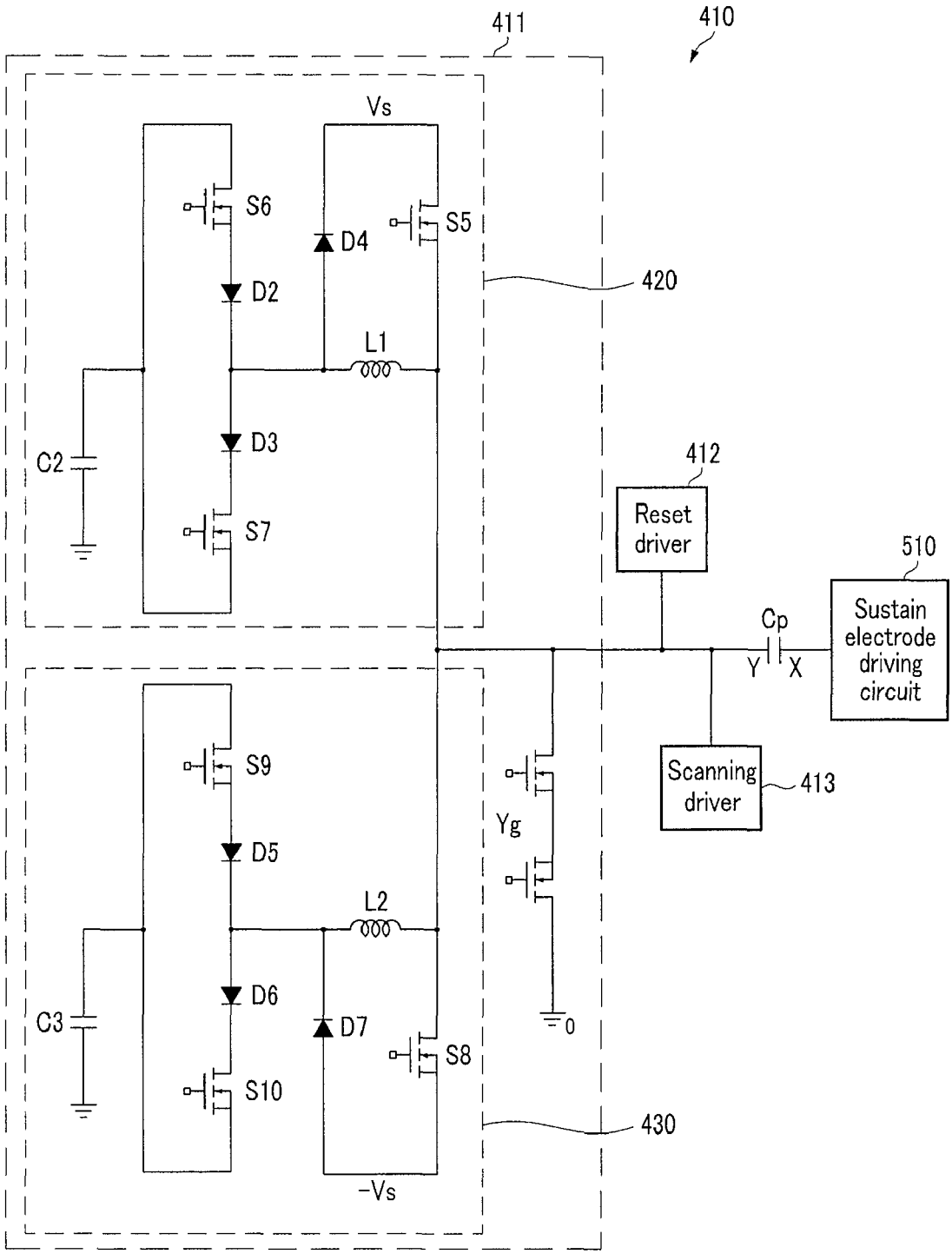
FIG. 6 is a diagram schematically illustrating a driving circuit of a scan electrode driver according to an exemplary embodiment of the present invention.

FIG. 6 is a diagram schematically illustrating a driving circuit 410 of the scan electrode driver 400 according to an exemplary embodiment of the present invention. For the purpose of better understanding and ease of description, FIG. 6 shows only the driving circuit 410 coupled to a plurality of Y electrodes Y1 to Yn. The sustain electrode driving circuit 510 is coupled to a plurality of X electrodes.

As shown in FIG. 6, the scan electrode driving circuit 410 includes a sustain driver 411, a reset driver 412, and a scanning driver 413, and the sustain driver 411 includes a first energy recovery unit 420 and a second energy recovery unit 430.

The first energy recovery unit 420 includes transistors S5, S6 and S7, an inductor L1, diodes D2, D3, and D4, and a capacitor C2, and the second energy recovery unit 430 includes transistors S8, S9, and S10, an inductor L2, diodes D5, D6, and D7, and a capacitor C3.

Hereinafter, the first energy recovery unit 420 is described in detail.

A source of the transistor S5 is coupled with the Y electrode of the panel capacitor Cp, and a drain of the transistor S5 is coupled with the Vs power source. A first terminal of the inductor L1 is coupled with the Y electrode of the panel capacitor Cp, and a second terminal thereof is coupled with the source of the transistor S6 and the drain of the transistor S7. The diode D4 is coupled between the second terminal of the inductor L1 and the Vs power source. In addition, the diode D2 is coupled between the inductor L1 and the source of the transistor S6, and the diode D3 is coupled between the inductor L1 and the drain of the transistor S7. The energy recovery capacitor C2 is coupled between ground and the drain of the transistor S6 and the source of the transistor S7, and the capacitor C2 is charged with Vs/2 voltage.

The second energy recovery unit 430 is hereinafter described in detail.

The Y electrode of the panel capacitor Cp is coupled with the drain of the transistor S8, and the source of the transistor S8 is coupled with the—Vs power source. The first terminal of the inductor L2 is coupled with the Y electrode of the panel capacitor Cp, and the second terminal thereof is coupled with the source of the transistor S9 and the drain of the transistor S10. The diode D7 is coupled between the—Vs voltage source and the second terminal of the inductor L2. In addition, the diode D5 is coupled between the inductor L2 and the source of the transistor S9, and the diode D6 is coupled between the inductor L2 and the drain of the transistor S10. The energy recovery capacitor C3 is coupled between ground and the drain of the transistor S9 and the source of the transistor S10, and the capacitor C3 is charged with the—Vs/2 voltage.

In the first energy recovery unit 420, the connection among the inductor L1, the diode D3, and the transistor S7 may be changed, and the connection among the inductor L1, the diode D2 and the transistor S6 may also be changed. For example, the inductor L1 may be coupled between a node between the transistors S6 and S7 and the energy recovery capacitor C2. Similarly, in the second energy recovery unit 430, the connection among the inductor L2, the diode D6 and the transistor S10 may be changed, and the connection among the inductor L2, the diode D5, and the transistor S9 may also be changed. In FIG. 6, the inductor L1 is coupled to the node between the transistors S6 and S7. However, at least two inductors may be coupled, respectively, in an upstream path formed by the transistor S6 and a downstream path formed by the transistor S7. This may also be applied to the second energy recovery unit 430.

The reset driver 412 is coupled to the Y electrode of the panel capacitor Cp and supplies a reset waveform to a plurality of Y electrodes during the reset period of the subfield. The scanning driver 413 applies a voltage Vscl to the Y electrode of the cell that will be turned on, and applies a voltage Vsch to the Y electrode of the cell that will not be turned on.

Figure 7:
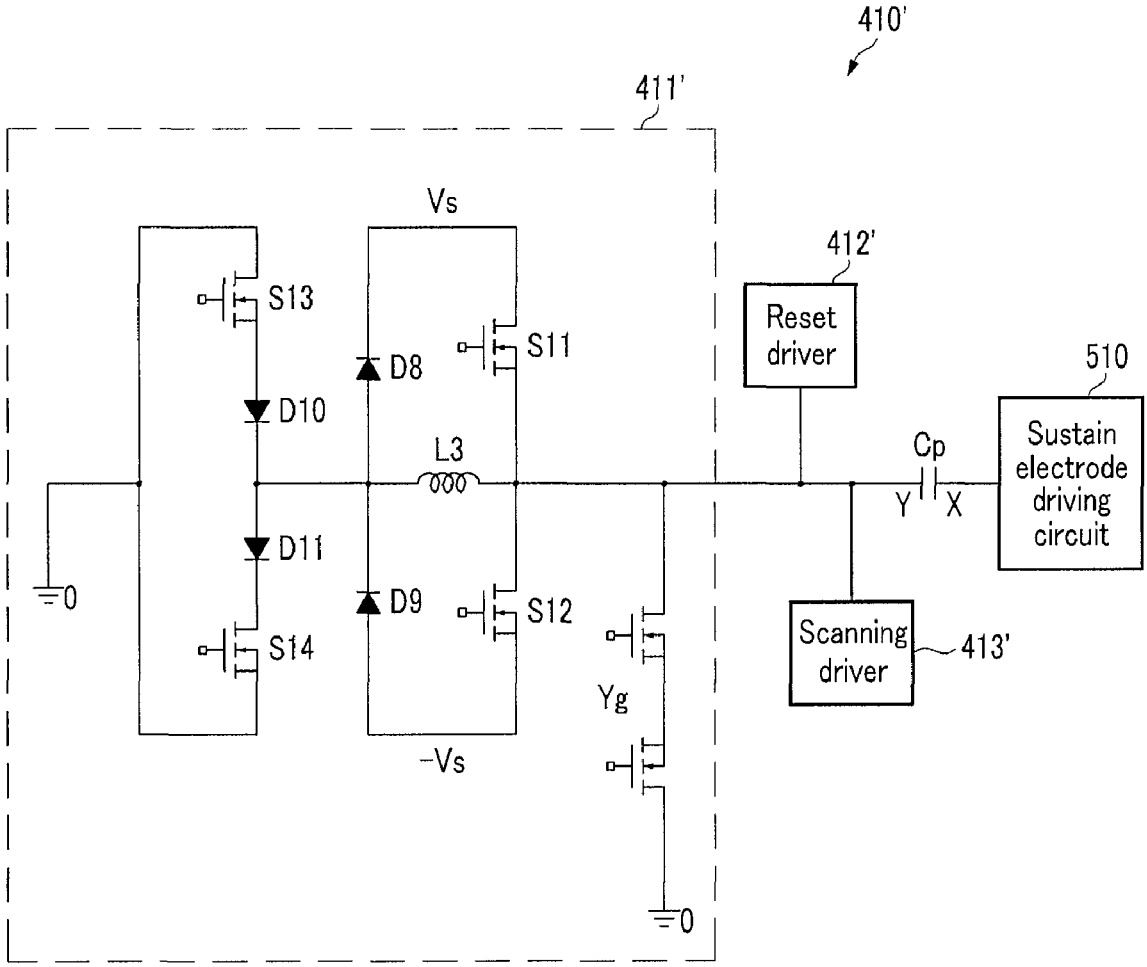
FIG. 7 is a diagram schematically illustrating a driving circuit of a scan electrode driver according to a second exemplary embodiment of the present invention.

FIG. 7 is a diagram schematically illustrating a driving circuit 410' of a scan electrode driver according to a second exemplary embodiment of the present invention. For better understanding and ease of description, FIG. 7 also shows only the driving circuit 410' coupled to a plurality of Y electrode Y1-Yn. The plurality of X electrodes are coupled with the sustain electrode driving circuit 510 that already has been described. As shown in FIG. 7, the scan electrode driving circuit 410' includes a sustain driver 411', a reset driver 412', and a scanning driver 413'.

The reset driver 412' and the scanning driver 413' of the second exemplary embodiment of the present invention are the same as those that have been described in connection with the first exemplary embodiment of the present invention. The sustain driver 411' includes transistors S11, S12, S13, and S14, an inductor L3, and diodes D8, D9, D10, and D11.

A source of the transistor S11 is coupled with the Y electrode of the panel capacitor Cp, a drain thereof is coupled with the Vs voltage source, a drain of the transistor S12 is coupled with the Y electrode of the panel capacitor Cp, and the source of the transistor S12 is coupled with the—Vs power source. The Y electrode of the panel capacitor Cp is coupled with a first terminal of the inductor L3. A second terminal of the inductor L3 is coupled with the Vs power source through the diode D8, and also coupled with the—Vs power source through the diode D9. The second terminal of the inductor L3 is also coupled with a source of the transistor S13 through the diode D10, and also coupled with a drain of the transistor S14 through the diode D11. A drain of the transistor S13 and a source of the transistor S14 are commonly grounded.

Although exemplary embodiments of the present invention have been described in detail, the scope of the present invention is not limited thereto. It should be understood by those skilled in the art that various modifications and changes of the invention can be made without departing from the scope of the invention using the basic conception of the invention defined by the following claims.

According to exemplary embodiments of the present invention, the voltage V1 that is higher than the voltage V2 applied in the falling period of the reset period is applied to the X electrode in the address period, and thus the difference between the voltages of the X electrode and the Y electrode increases, which makes it possible to facilitate a discharge condition. The voltages V1+V2, V1, and V2 are applied to the X electrode in the entire driving structure, which makes it possible to design transistors that can resist the voltage V1 or V2, but not necessarily the sum of the voltages V1 and V2. That is, it is possible to use transistors having a low resisting voltage in the sustain driving circuit. An element having a reduced resisting voltage has a small resistance value, which makes it possible to reduce an electrical loss and to reduce heat generated from the element. In addition, the sustain driving board supplies only the voltage applied to the X electrode in the pre-reset period, the falling period of the reset period, and the address period, which causes the occupied areas of the driving boards on a chassis base to be reduced. As a result, it is possible to reduce the total cost of circuits required to drive a plasma display device.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display device having a plurality of cells for displaying an image, the plasma display device comprising:

a plurality of first electrodes;

a first transistor having a first terminal electrically coupled to the plurality of first electrodes and a second terminal electrically coupled to a first power source for supplying a first voltage;

a second transistor having a first terminal electrically coupled to the plurality of first electrodes;

a first capacitor having a first terminal electrically coupled to the second terminal of the first transistor and a second terminal electrically coupled to a second terminal of the second transistor;

a third transistor having a first terminal electrically coupled to the second terminal of the first capacitor and a second terminal electrically coupled to a second power source for supplying a second voltage;

a fourth transistor having a first terminal electrically coupled to the second terminal of the first capacitor and a second terminal electrically coupled to a third source for supplying a third voltage; and a controller for controlling the first, second, third and fourth transistors during a subfield comprising a first period, a second period, a third period, a fourth period and a fifth period, such that the first transistor is turned on during the first period, the second and fourth transistors are turned on during the second period, the first and third transistors are turned on during the third period, the second and fourth transistors are turned on during the fourth period, and the third and second transistors are turned on during the fifth period.

2. The plasma display device of claim 1, wherein:

the first period is an address period;

the second period is a sustain period;

the third period is a pre-reset period;

the fourth period is a rising period of a reset period; and the fifth period is a falling period of the reset period.

3. The plasma display device of claim 2, wherein the third voltage is a ground voltage, the first and second voltages are positive voltages, and the first voltage is higher than the second voltage.

4. The plasma display device of claim 3, further comprising a diode having a cathode coupled to the second terminal of the first transistor and an anode coupled to the first power source.

5. The plasma display device of claim 4, further comprising:

a plurality of second electrodes for performing a display operation together with the plurality of first electrodes;

a reset driver coupled to the plurality of second electrodes and adapted to supply reset waveforms to the plurality of second electrodes during the reset period of the subfield;

a scanning driver coupled to the plurality of second electrodes, adapted to apply a low scan voltage to one of the second electrodes corresponding to a first cell that will be turned on among the plurality of cells, and to apply a high scan voltage to another one of the second electrodes corresponding to a second cell that will not be turned on among the plurality of cells; and a sustain driver for supplying sustain pulses to the plurality of second electrodes.

6. The plasma display device of claim 5, wherein the sustain driver comprises:

a first energy recovery unit comprising a first inductor having a first terminal coupled to the second electrodes and a second terminal, and adapted to change the voltage of the second electrodes through the first inductor; and a second energy recovery unit comprising a second inductor having a first terminal coupled to the second electrodes and a second terminal, and adapted to change the voltage of the second electrodes through the second inductor.

7. The plasma display device of claim 6, wherein the first energy recovery unit further comprises:

a fifth transistor coupled to the first terminal of the first inductor and a fourth power source for supplying a fourth voltage;

a sixth transistor having a first terminal coupled to the second terminal of the first inductor;

a seventh transistor having a first terminal coupled to the second terminal of the first inductor; and a second capacitor having a first terminal coupled to a second terminal of the sixth transistor and a second terminal of the seventh transistor and a second terminal coupled to a fifth power source for supplying a fifth voltage, and the second energy recovery unit further comprises:

an eighth transistor coupled between the first terminal of the second inductor and a sixth power source for supplying a sixth voltage;

a ninth transistor having a first terminal coupled to the second terminal of the second inductor;

a tenth transistor having a first terminal coupled to the second terminal of the second inductor; and a third capacitor having a first terminal coupled to a second terminal of the ninth transistor and a second terminal of the tenth transistor and a second terminal coupled to a seventh power source for supplying a seventh voltage.

8. The plasma display device of claim 5, wherein the sustain driver comprises:

a first inductor having a first terminal coupled with the second electrode;

a fifth transistor coupled between the first terminal of the first inductor and a fourth power source for supplying a fourth voltage;

a sixth transistor coupled between the first terminal of the first inductor and a fifth power source for supplying a fifth voltage;

a seventh transistor coupled between a second terminal of the first inductor and a sixth power source for supplying a sixth voltage; and an eighth transistor coupled between the second terminal of the first inductor and the sixth power source.

9. A method of driving a plasma display device including a plurality of first electrodes and a plurality of second electrodes for performing a display operation during a plurality of subfields, at least one of the subfields comprising an address period, a sustain period, a pre-reset period and a reset period, the method comprising:

turning on at least one first transistor that is electrically coupled between a first power source for supplying a first voltage and the plurality of first electrodes during the address period to apply the first voltage to the plurality of first electrodes;

turning on at least one second transistor that is electrically coupled to a second power source for supplying a second voltage during the sustain period to apply the second voltage to the plurality of first electrodes;

turning on the at least one first transistor and at least one third transistor that is electrically coupled to a third power source for supplying a third voltage during the pre-reset period to apply a fifth voltage to the plurality of first electrodes through a first capacitor having a fourth voltage charged thereto, the fifth voltage corresponding to a sum of the third voltage and the fourth voltage;

turning on the at least one second transistor that is electrically coupled to the second power source for supplying the second voltage during a rising period of the reset period to apply the second voltage to the plurality of first electrodes; and applying the third voltage to the plurality of first electrodes through at least one of the at least one second transistor or the at least one third transistor that is electrically coupled to the third power source for supplying the third voltage during a falling period of the reset period.

10. The method of driving a plasma display device of claim 9, wherein the applying of the second voltage to the first electrodes during the sustain period includes charging the first capacitor to the fourth voltage.

11. The method of driving a plasma display device of claim 10, wherein the first voltage is equal to the fourth voltage, and the second voltage is a ground voltage.

12. A device for driving a plasma display device including a first electrode and a second electrode, the device comprising:

a first path between a first power source for supplying a first voltage and the first electrode, wherein the first voltage is supplied to the first electrode through the first path;

a second path between the first power source and a second power source for supplying a second voltage, wherein a first capacitor having a first terminal coupled to the first power source and a second terminal coupled to the second power source is charged to a third voltage through the second path;

a third path between a third power source for supplying a fourth voltage and the first electrode and for allowing a fifth voltage to be supplied to the first electrode through the first capacitor charged to the third voltage;

a fourth path between the second power source and the first electrode, wherein the second voltage is supplied to the first electrode through the fourth path; and a fifth path between the third power source and the first electrode, wherein the fourth voltage is supplied to the first electrode through the fifth path, wherein:

the first path includes at least one first transistor having a source coupled to the first electrode and a drain coupled to the first power source;

the second path includes at least one second transistor having a drain coupled to the second terminal of the first capacitor and a source coupled to the second power source;

the third path includes the at least one first transistor and at least one third transistor having a drain coupled to the third power source and a source coupled to the second terminal of the first capacitor;

the fourth path includes the at least one second transistor and at least one fourth transistor having a drain coupled to the first electrode and a source coupled to the second terminal of the first capacitor;

the fifth path includes the at least one third transistor and the at least one fourth transistor;

the at least one first transistor is turned on to supply the first voltage to the first electrode;

the at least one second transistor and the at least one fourth transistor are turned on to charge the first capacitor to the third voltage;

the at least one first transistor and the at least one third transistor are turned on to supply the fifth voltage to the first electrode;

the at least one second transistor and the at least one fourth transistor are turned on to supply the second voltage to the first electrode; and the at least one third transistor and the at least one fourth transistor are turned on to supply the fourth voltage to the first electrode.

13. The device for driving a plasma display device of claim 12, wherein the first path further comprises a diode having a cathode coupled to the drain of the at least one first transistor and an anode coupled to the first power source.

14. The device for driving a plasma display device of claim 12, wherein the second voltage is supplied to the first electrode through the at least one second transistor and at least one fourth transistor that are in an on state while the second path is being formed.

* * * * *